US005671643A

United States Patent [19]

Henkhaus

[11] Patent Number: 5,671,643

[45] Date of Patent: Sep. 30, 1997

[54] EXTENSION WRENCH FOR WATER METER NUT

[76] Inventor: John K. Henkhaus, 130 S. Church, Virden, Ill. 62690

[21] Appl. No.: 605,470

[22] Filed: Feb. 26, 1996

[51] Int. Cl.[6] ..... B25B 13/46

[52] U.S. Cl. ..... 81/57.39; 81/57.4; 81/58.2

[58] Field of Search ..... 81/57.39, 57.4, 81/58.2, 58; 87/57.24, 462

[56] References Cited

U.S. PATENT DOCUMENTS

| | | | |
|---|---|---|---|
| 493,273 | 3/1893 | Killinger | 81/58.2 |
| 2,954,715 | 10/1960 | Wycech | 81/57.39 |
| 3,334,671 | 8/1967 | Agostini et al. | 81/57.4 |
| 3,616,714 | 11/1971 | Gregory | 81/57.39 |
| 4,031,785 | 6/1977 | Wheeler | 81/57.39 |
| 4,098,151 | 7/1978 | Bliss | 81/57.3 |
| 4,334,443 | 6/1982 | Pearson | 81/55 |
| 4,339,969 | 7/1982 | Hage | 81/57.39 |
| 4,492,133 | 1/1985 | Schosek | 81/57.3 |
| 4,562,757 | 1/1986 | Furey | 81/58.2 |
| 4,630,511 | 12/1986 | Shirley | 81/462 |
| 5,277,087 | 1/1994 | Wilson, Jr. et al. | 81/58.2 |
| 5,309,796 | 5/1994 | Jones | 81/57.39 |
| 5,320,003 | 6/1994 | Ely et al. | 81/57.4 |

FOREIGN PATENT DOCUMENTS

| | | | |
|---|---|---|---|
| 60-20829 | 2/1985 | Japan | 81/57.4 |

*Primary Examiner*—D. S. Meislin
*Assistant Examiner*—Joni B. Danganan

[57] ABSTRACT

An extension wrench is presented which is especially adapted to remove nuts from underground water meters which are located in a confined space. The invention is approximately six feet long having two handles at the top and a ratchet mechanism located at the bottom. One of the two handles is movable and supplies force to the ratchet mechanism some six feet below the pivoting handle. The ratchet mechanism can be placed around a nut in a confined area. The ratchet mechanism has an open-ended but latched portion. As the ratchet mechanism rotates to loosen or tighten a nut, the latch mechanism automatically closes. Loosening or tightening of the nut is accomplished by simply reversing the direction of the device by 180 degrees. Also provided is a mechanism to retain the nut within the ratchet mechanism while the nut is being tightened.

3 Claims, 6 Drawing Sheets

EXTENSION WRENCH FOR WATER METER NUT

BACKGROUND OF THE INVENTION

This is invention relates to an elongated ratchet mechanism for loosening and tightening underground nuts such as are commonly found on water meters. More particularly, it relates to a long extension wrench which is capable of loosening the nuts on a water meter making the removal of underground water meters much easier than was heretofore known in the art. The invention enables a workman to remove or install a water meter without laying on the ground, possibly in water, ice or snow. The meter can be changed in the upright position without placing the workman's knee on the ground.

Ratchet wrenches are commonly known throughout the mechanical arts. They operate utilizing a ratchet and pawl mechanism with the hexagonal ratchet head being driven by the ratcheting mechanism. Extensions for these wrenches are also known in the art. However, these extensions commonly take the form of simple solid extension arms and usually operate at right angles to the rotation of the ratcheting mechanism.

In certain fields, such as the field which involves the removal of underground water meters, it is difficult to attach and operate a ratchet wrench in the enclosures which commonly house the underground water meters. The current wrench of choice is a pipe wrench, which requires the worker to lay on the ground in order to reach the sunken meter. Even if the wrench can be attached in the working area, the space in which the ratchet arm may be rotated is usually quite confined. The result is a laborious and time consuming procedure in which a hexagonal nut is loosened or tightened slowly due to the confined area in which the workman is able to operate. It is an object of this invention to provide a ratchet mechanism which allows the workman to rapidly remove hexagonal nuts from water meters or other items in a confined space.

It is another object of this invention to allow a workman to remove the tightening nuts from a water meter or other item located in a confined space using an approximately six foot extension. Since the mechanism is operated from the free end of the six foot extension, the confined space in which the nut to be loosened is located is not an impediment to the efficient tightening or loosening of the nut as required.

It is a further object of this invention to provide a specialized tool of varying lengths for removing nuts in confined spaces and for tightening such nuts when appropriate. It is a still further object of this invention to provide a highly specialized tool for removing water meters from underground spaces.

Still further objects of this invention will become apparent upon reading the below described Specification.

BRIEF DESCRIPTION OF THE INVENTION

This invention comprises an extension wrench which is approximately six feet long. At the top of the extension wrench are located a pair of handles. One handle is fixed and the other handle is movable in a lever action. Moving the upper lever handle transmits force to an essentially vertical rod which is in mechanical contact with a lower ratchet mechanism. The lower ratchet mechanism, located approximately six feet below the handle lever mechanism, is adapted to be attached to an underground nut such as is commonly found in an underground water meter. The lower ratchet mechanism has a latch opening such that the lower ratchet drive can be secured around the yoke pipe. As the upper handle is moved, the ratchet mechanism rotates about the pipe and closes the latch mechanism. The wrench is then moved onto the tightening nut. Further movement of the upper handle loosens the nut as required. In order to secure the nut to the mechanism, a nut retaining mechanism presses the nut onto the water meter. The nut retaining mechanism is manually operated. For reattaching the water meter, the mechanism is simply rotated 180 degrees so that the movement of the upper lever will then provide a tightening rotation to the nut.

BRIEF DESCRIPTION OF THE DRAWINGS

FIG. 10 depicts the invention as it would be positioned prior to placing the ratchet mechanism over the meter yoke pipes before moving it onto the nut.

FIG. 11 shows the nut retaining mechanism as it is extended over the hexagonal nut.

DESCRIPTION OF THE PREFERRED EMBODIMENT

Figure 1:
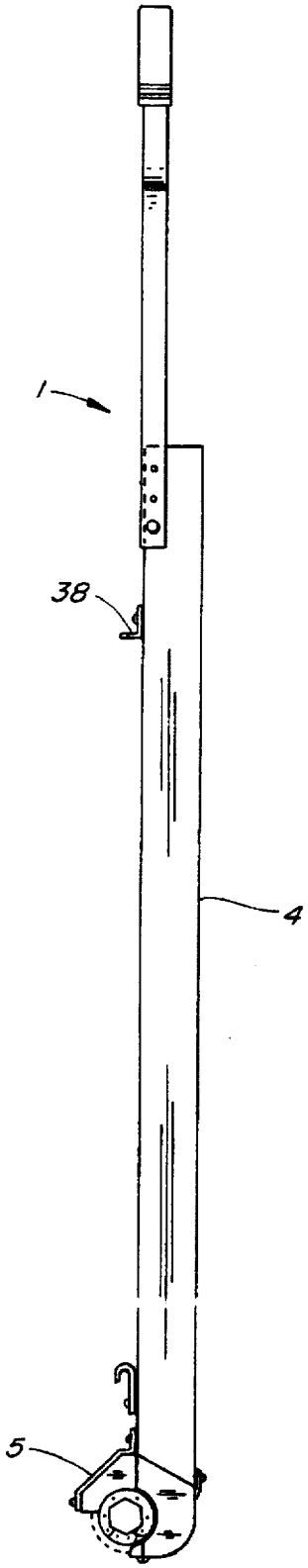
FIG. 1 is a side view of the extension wrench.
Figure 2:
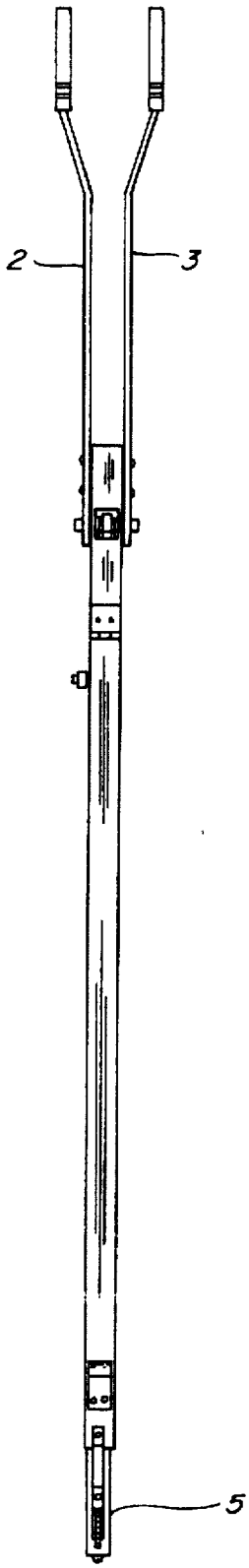
FIG. 2 is a front view of the extension wrench showing the pair of upper handles and the lower ratchet mechanism.

An extension wrench for removing hexagonal nuts from underground water meters located in confined spaces is shown. As best depicted in FIGS. 1 and 2, the extension wrench 1 comprises a pair of upper handles 2 and 3. This pair of handles includes a movable handle lever 2 and a fixed handle 3. The fixed handle 3 is secured to the rectangular main body 4 of the extension wrench. The movable handle lever 2 is secured to the opposite side of the rectangular main body 4 and is capable of rotating about a pivot point.

The main body 4 has an essentially rectangular cross-section. However, this main body 4 may have any type of cross-section suitable for the containment and strength necessary to connect the upper lever mechanism to the lower ratchet mechanism 5. As shown in FIGS. 1 and 2, the extension wrench also has a lower ratchet mechanism 5. This lower ratchet mechanism 5 will be more specifically described below.

Figure 3:
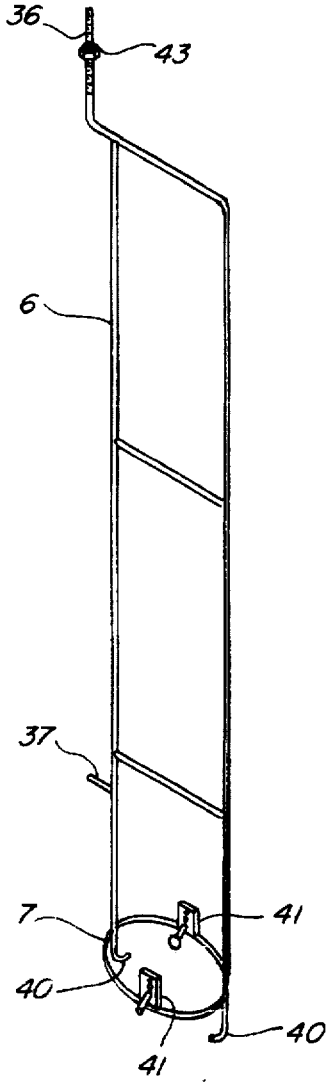
FIG. 3 is a perspective view of the stabilizing bracket which is attached to the extension wrench to stabilize and align the water meter with the nuts on the yoke. It also prevents the water meter from spinning when tightening.
Figure 4:
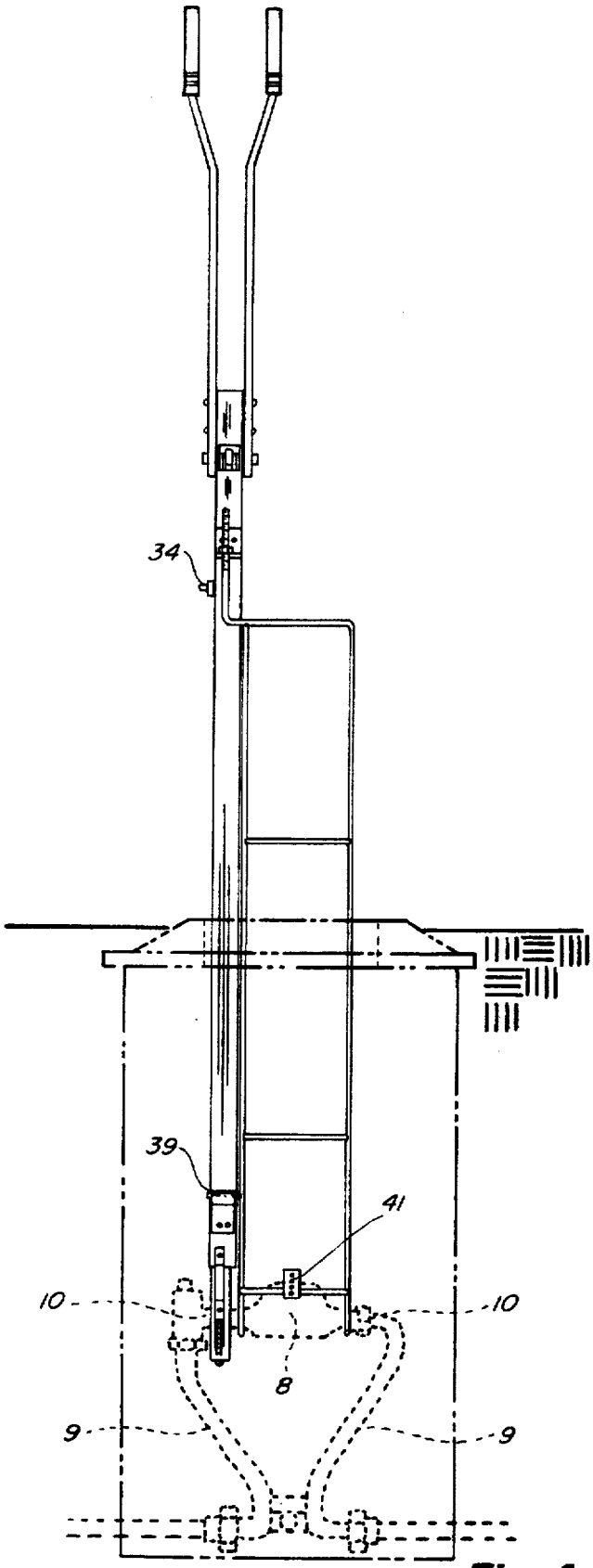
FIG. 4 is a side view of the extension wrench and stabilizing bracket as it would be used to remove the nut from a water meter. The water meter and meter yoke are shown in dotted lines on FIG. 4.

In using the extension wrench 1 to loosen the hexagonal nuts from a water meter or other device in a confined space shown in FIG. 4, it may also be necessary to attach a stabilizing bracket 6 as best shown in FIG. 3, to the extension wrench 1. This stabilizing bracket 6, shown in FIG. 3, is attached to the extension wrench 1 as shown in FIG. 4.

The lower reversed Js 40 of the stabilizing bracket 6 (FIG. 3) are adapted to be secured about the water meter connecting pipes 9, as best shown in FIG. 4. These lower Js 40 are located at the lower end 7 of the stabilizing bracket 6 and are used to stabilize the water meter 8 as torque is applied to the movable handle lever 2 and transmitted to the ratchet mechanism 5.

As best shown in FIG. 4 a water meter 8 is normally located below the ground surface. FIG. 4 shows the ground surface cut away so that the underground water meter 8 is accessible through a removable water meter plate located parallel to the ground surface. The water meter 8 is connected to the water line through water meter connecting threads on the ends of water meter 8. These connecting pipes are attached to either side of the water line and are connected to either side of the water meter 8 by means of water meter connecting nuts 10. These connecting nuts are generally 1⅝ inch nuts, and are commonly known throughout the trade. It is the loosening and tightening of these nuts that is a main object of the present device.

Figure 5:
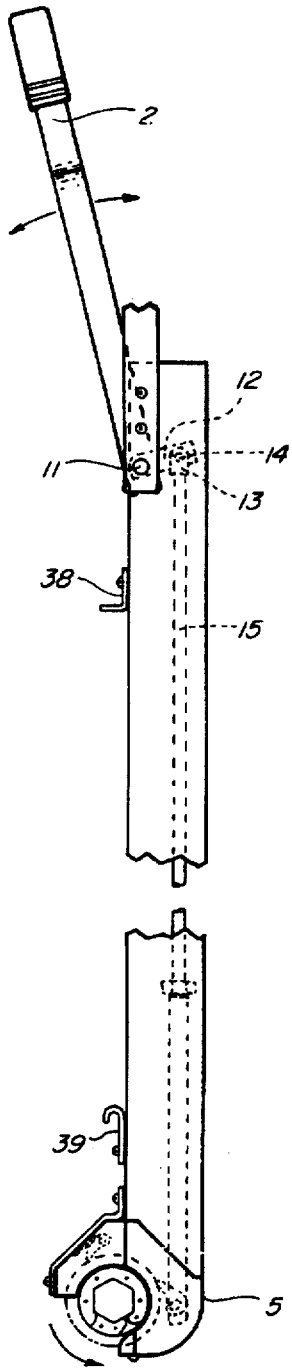
FIG. 5 is a side view of the extension wrench showing the movable handle lever slightly rotated.

Turning now to FIG. 5, the extension wrench is depicted with the movable handle lever arm 2 slightly rotated. This lever arm 2 is tightly connected to a lever shaft 11. The lever shaft 11 rotates according to the movement of the movable handle lever arm 2. Rotating the lever shaft 11 in turn rotates the lever shaft connector 12 (also shown on FIGS. 6 and 7). This lever shaft connector 12 is in turn connected about a pivot point 14 to a lever shaft yoke 13. This upper mechanism is more fully shown in FIGS. 6 and 7.

The movable handle lever 2 is thus mechanically connected to the ratchet drive rod 15 through the lever shaft, connector, and yoke. The ratchet drive rod 15 is a stiff rod running down the inner portion of the main body 4 and connected to the lower ratchet mechanism 5. The transmission of force from the ratchet drive rod 15 to the lower ratchet mechanism 5 will be explained as further described below.

Figure 6:
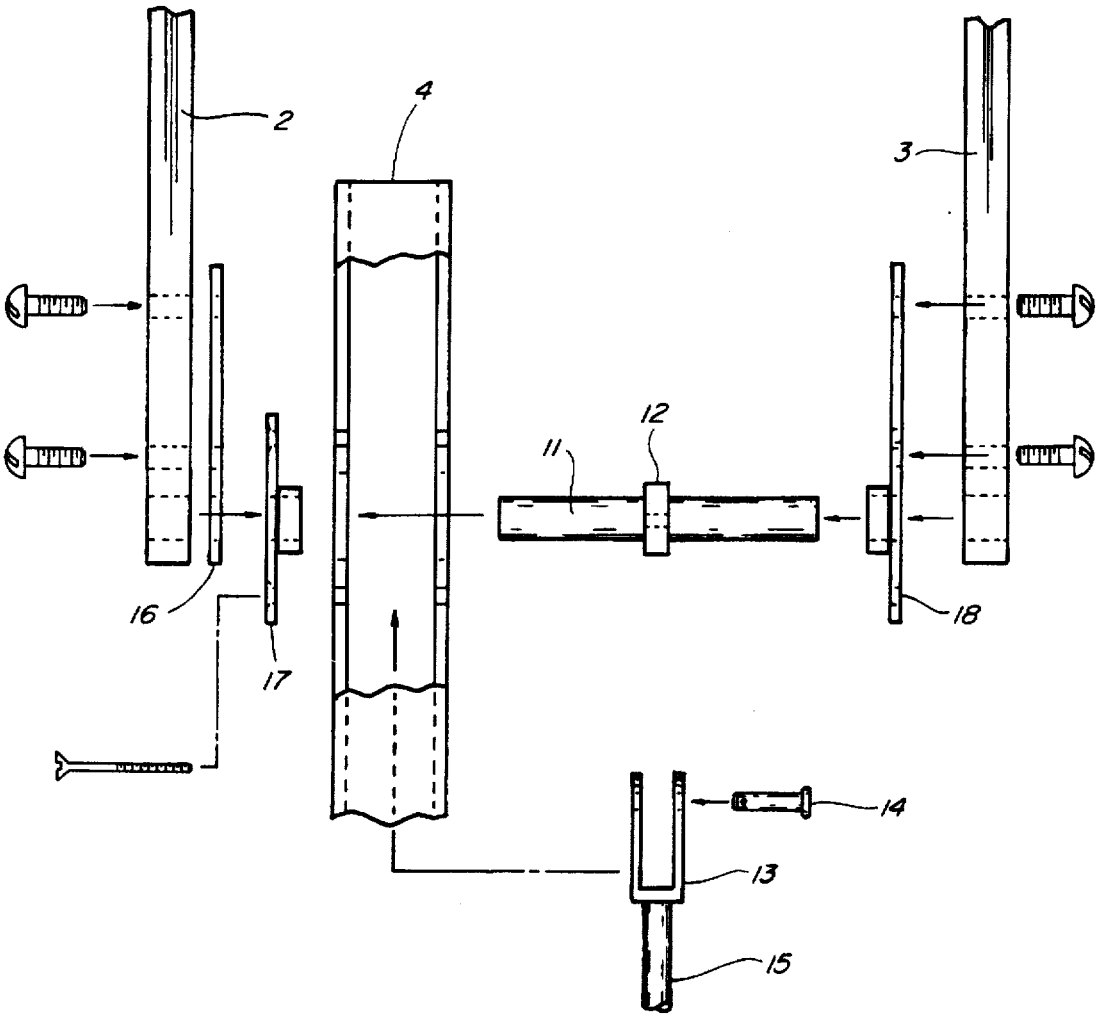
FIG. 6 is a side exploded cut-away view of the upper portion of the wrench, showing the movable and fixed handles as well as the lever shaft and yoke.
Figure 7:
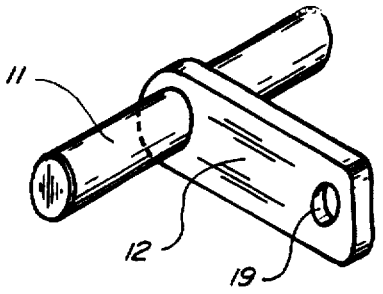
FIG. 7 is a perspective view of the lever shaft and yoke depicted in the exploded view in FIG. 6.

The upper lever mechanism is best shown in FIGS. 6 and 7. Referring specifically to FIG. 6, the movable handle lever 2 is shown opposite the fixed handle 3. The pair of handles are connected by screws to the main rectangular body 4. The movable handle lever 2 is attached to the rectangular body 4 through screws. A movable handle spacer plate 16 and a movable handle bearing plate 17 are attached between the movable handle lever 2 and the left side of the rectangular main body 4 as shown. The right fixed handle 3 is also connected to the main body 4. A fixed handle bearing plate 18 is located between the fixed handle 3 and the right side of the main body 4 as shown.

Inside the main body 4 is located a lever shaft 11. This lever shaft 11 is cylindrical in shape. The lever shaft 11 rides in the bearing plate openings as shown in FIG. 6. Attached to this lever shaft 11 is a lever shaft connector 12.

The lever shaft 11 and lever shaft connector 12 are best shown in FIG. 7. The lever shaft is located as shown on FIG. 5. The lever shaft connector 12 protrudes from the lever shaft 11 inside the main body 4, as best shown on FIG. 5. At the far end of the lever shaft connector 12 is a lever shaft connector pivot point 19. Referring to both FIGS. 6 and 7, a lever shaft yoke 13 is pivotably connected to the lever shaft connector 12 about lever shaft connector pivot point 19. This connection is made by placing the yoke 13 over the pivot point 19 and pivotably connecting the yoke and shaft connector by means of a lever shaft yoke pin 14. As shown in FIG. 5, the movable handle lever arm 2 is thus connected to the ratchet mechanism 5 through the lever shaft 11, connector 12, yoke 13, and ratchet drive rod 15. The ratchet drive rod 15, fixably attached to the lever shaft yoke 13, supplies the driving force to the ratchet mechanism 5.

Figure 8:
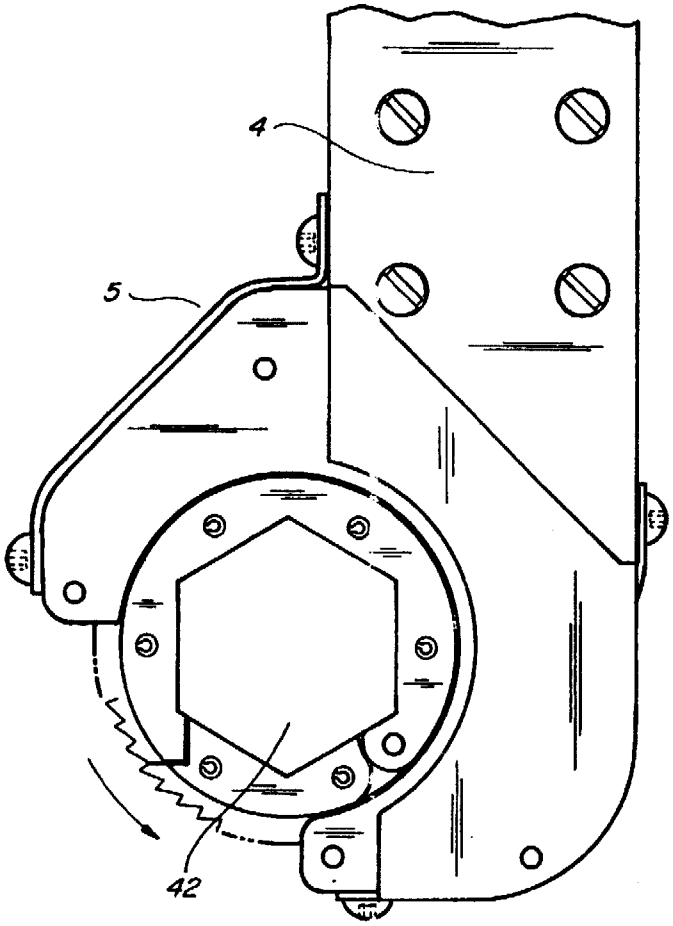
FIG. 8 is an enlarged view of the lower portion of the extension wrench showing the ratchet mechanism.

As shown in FIG. 8, the lower ratchet mechanism 5 is connected mechanically to the movable handle lever 2 through the ratchet drive rod 15. A hexagonal nut opening 42 is located in the inner portion of the ratchet mechanism. This hexagonal nut opening 42 is adapted to fit the hexagonal nut of a water meter connector.

Obviously, the hexagonal nut opening 42 may be made of many different sizes, either English or metric, so as accommodate varying nut sizes. Due to the versatile nature of the instant invention, it may be used not only on water meter nuts located underground but for other nuts which may be located in extremely confined areas. The simple changing of the lower ratchet mechanism 5 so as to accommodate varying nut sizes will enable this versatile device to be used in a wide variety of applications. The water meter nut loosening and tightening application described here is meant as a means of illustration only and not as a limitation on the usefulness or adaptability of the instant device.

Figure 9:
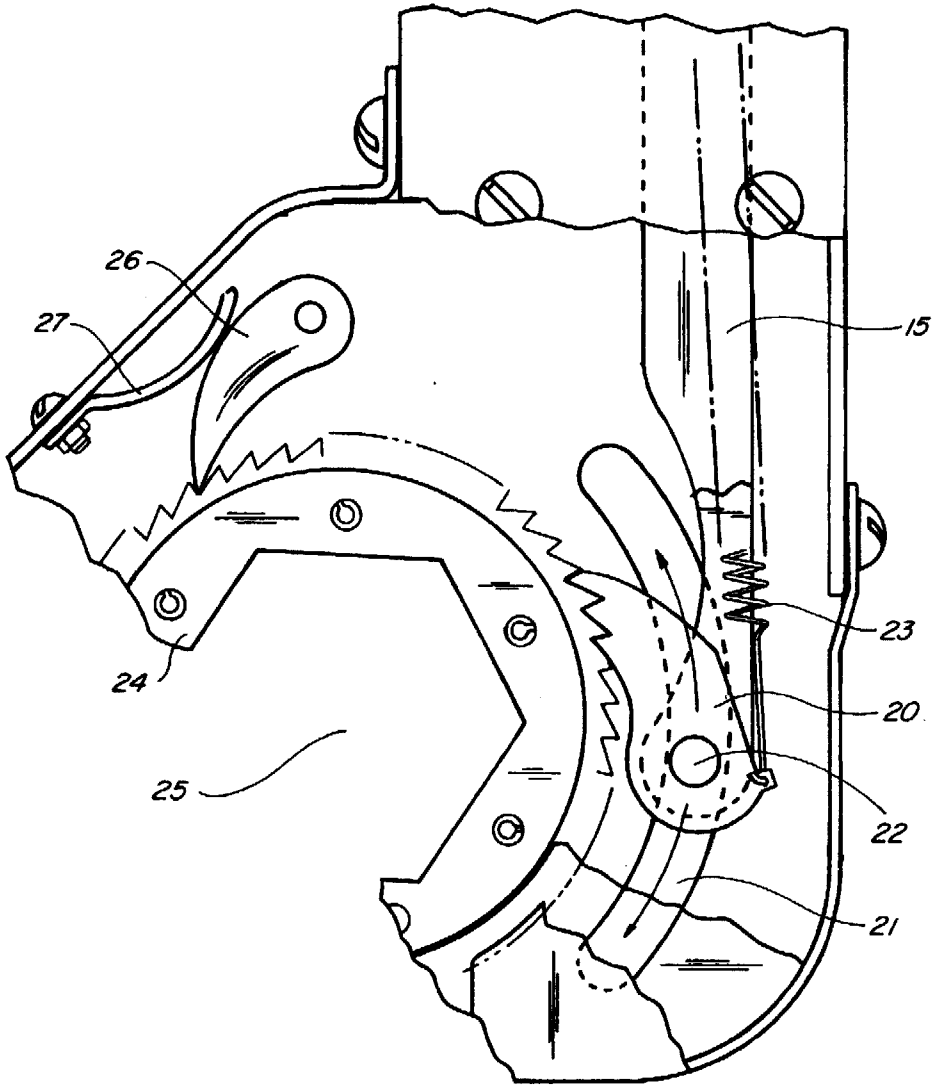
FIG. 9 is a view similar to that of FIG. 8, however, having the outer covering of the ratchet mechanism removed showing the inner components of the ratchet mechanism.

As best shown in FIG. 9, the inner ratchet mechanism is designed to receive the force from the ratchet drive rod 15 and to rotate in a counterclockwise direction as shown in the right side cut-away view of FIG. 9 (similar to FIG. 1). The inner mechanism comprises essentially a ratchet drive pawl 20 which pivots about a ratchet drive pawl pivot 22. The drive pawl 20 and pivot point 22 are located within a ratchet drive pawl groove 21. This ratchet drive pawl groove 21 is semi-circular in geometric shape and allows the ratchet drive pawl 20 to move in the counterclockwise direction to drive the mechanism. The ratchet drive pawl 20 is biased towards the ratchet gear 24 teeth by the resilient retaining spring 23. When the movable handle lever arm 2 is rotated downward, the ratchet gear 24 is driven in the counterclockwise direction. When the lever arm is rotated back to the upright position, the spring return mechanism 23 allows the ratchet drive pawl mechanism 20 to be released from contact with the ratchet gear teeth. The movable handle lever arm 2 may then have force applied to it again in the downward position to further move the ratchet gear 24 in the counterclockwise position.

The partial hexagonal nut opening 25, shown in FIG. 9, is located such that the entire lower ratchet mechanism 5 may be placed around the hexagonal nut to be tightened or loosened. A ratchet gear locking pawl 26 is also biased as shown in FIG. 9 by ratchet pawl bias spring 27. This ratchet gear locking pawl 26 is positioned such that the ratchet mechanism may only be driven in the counterclockwise direction.

Figure 10:
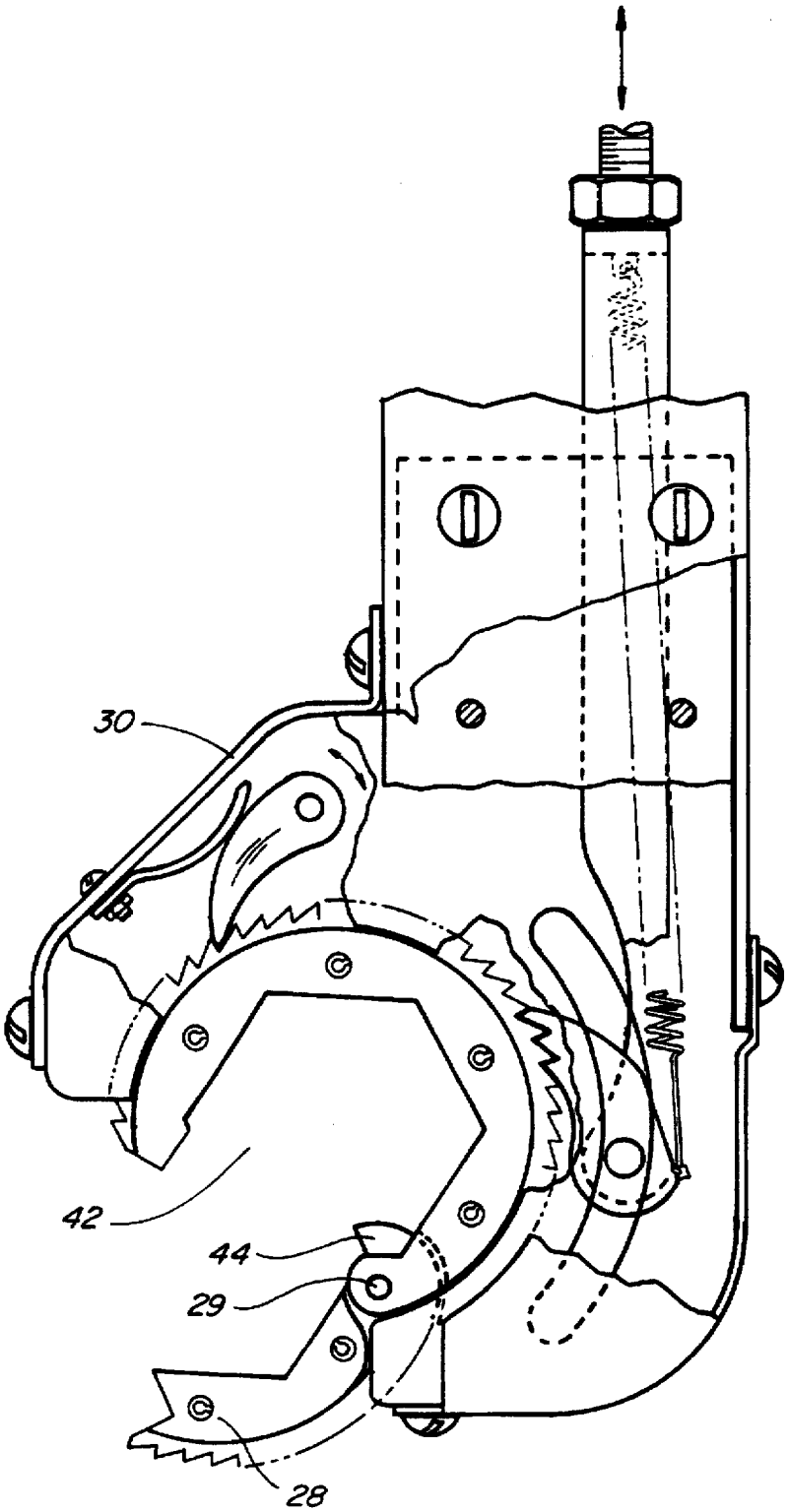
FIG. 10 is a view similar to FIG. 9 also showing the ratchet gear latching piece.

As best shown in FIG. 10, a ratchet gear latching piece 28 is provided to allow the yoke pipe to be inserted within the hexagonal nut opening 42. The ratchet gear latching piece 28 is part of the ratchet gear 24. When, the ratchet gear latching piece 28 is in the position shown in FIG. 10, it pivots about latching piece pivot point 29 by the force of gravity such that the hexagonal opening 42 is accessible. The ratchet mechanism 5 is inserted into the opening containing the water meter in the condition as shown in FIG. 10. The lower portion of the extension wrench is placed over the yoke pipe and the movable handle lever arm 2 is pivoted such that the ratchet gear 24 is rotated in the counterclockwise position. This counterclockwise rotation of the ratchet gear 24 forces the ratchet gear latching piece 28 to close as the latching piece pivot point 29 moves in a counterclockwise direction and encounters the unopened portion of the circular orbit of the ratchet gear 24. The latching piece shoulder 44 locks the latching piece shut when closed and placed over a nut. This action transforms the ratchet into a closed end wrench. Such a closed end wrench is less likely to slip. For removal of the mechanism, the ratchet gear latching piece is returned to the position shown in FIG. 10 and the latching piece re-opens by the force of gravity. The front portion of the ratchet mechanism 5 is covered by a ratchet mechanism front piece 30.

Figure 11:
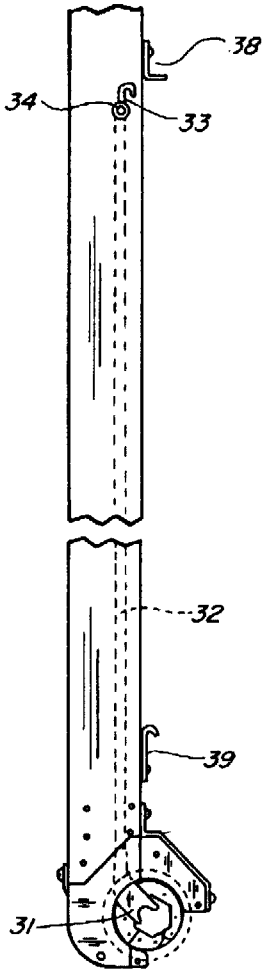
FIG. 11 is the opposite side view of the extension wrench shown in FIGS. 5 and 8.

Turning to FIG. 11 and the left side of the extension wrench, a nut retaining mechanism 31 is shown. As depicted on FIG. 11, this nut retaining mechanism 31 consists of an irregularly shaped metal arm which protrudes over the outer edge of the nut to be tightened. The nut retaining mechanism 31 is operated by the up and down motion of the nut retaining mechanism rod 32 shown on FIG. 11. This rod is actuated by moving the nut retaining mechanism activation handle 34 downwards (to move the nut retaining mechanism 31 over the nut) and upwards (to retract the nut retaining mechanism 31).

The nut retaining mechanism activation handle 34 moves within an inverted J-stop 33 such that when the activation handle 34 is down (as shown in FIG. 11), the retaining mechanism 31 protrudes over the nut. When the nut retaining mechanism activation handle is upward and to the right, the nut retaining mechanism is in the retracted position. The purpose of this nut retaining mechanism 31 is to secure the extension wrench 1 and particularly the ratchet mechanism 5 to the nut, and to press the nut onto the pipe threads as the nut is tightened.

Figure 12:
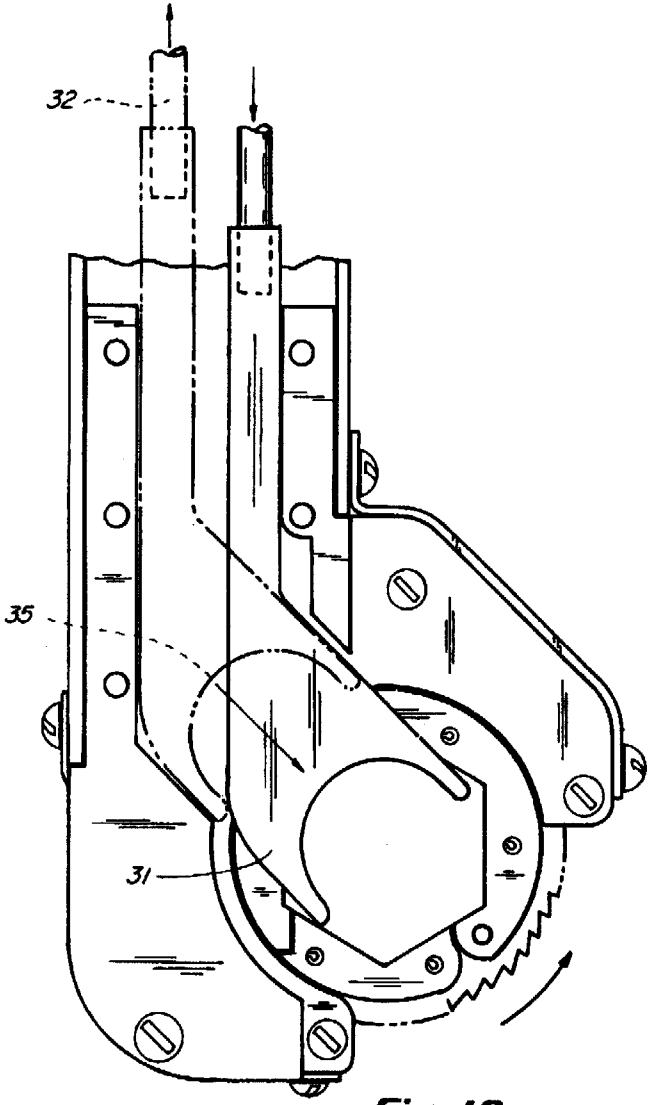
FIG. 12 is an enlarged view of the lower nut retaining mechanism, with the outside covering removed, showing the inner mechanism of the nut retaining pieces.

A more detailed view of this nut retaining mechanism 31 is shown in FIG. 12. This nut retaining mechanism 31 is shown as it is positioned over the end of the water meter nut. However, as shown in phantom lines in FIG. 12, the nut retaining mechanism is located in its retracted position 35 when the activation handle 34 is pulled upwards and to the right in the J-stop 33 shown on FIG. 11. Since the views of the nut retaining mechanism shown in FIGS. 11 and 12 are on the side opposite from that shown in FIGS. 9 and 10, the rotation of the ratchet gear 24 is likewise reversed. The nut retaining mechanism 31 presses the yoke nuts onto the threads on the water meter 8 when tightening the nut.

Figure 13:
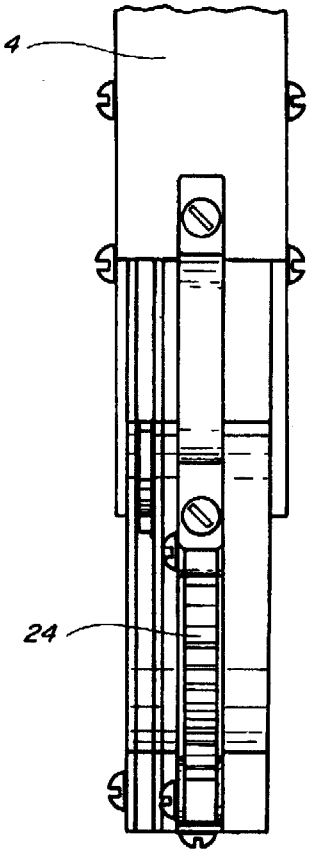
FIG. 13 is a front view of the lower ratchet mechanism with the covering pieces removed, showing the inner parts of the ratchet mechanism.

FIG. 13 shows a front close-up view of the ratchet mechanism of the instant invention. Various spacing devices are present in this mechanism to insure that the wear of the movable parts will be at a minimal and to insure that the mechanism described in this device will be long lasting and hardy.

The upper movable handle lever arm 2 provides a large mechanical advantage to the usual ratcheting devices. The lever moment arms provide an approximately 9:1 mechanical advantage so that a 10 pound downward pressure on the movable handle lever arm 2 provides approximately 100 pounds of torque to the lower ratchet mechanism 5. However, this greatly increased torque on the water meter nuts necessitates the addition of the stabilizing bracket 6 shown in FIG. 3.

The stabilizing bracket 6 shown in FIG. 3 has an upper portion with an upper vertical stabilizing bracket arm 36. This upper vertical stabilizing bracket arm 36 is placed into the L-shaped upper securing mechanism 38 shown on FIG. 1. The lower portion 7 of the stabilizing bracket 6 is secured about the water meter by means of lower attaching Js 40 and lower attaching thumbscrews 41. The lower Js 40 are arranged as shown on FIG. 3. Each of these lower Js may be attached near the water meter connecting threads as shown in FIG. 4. The thumbscrews 41 are then tightened such that the lower portion of the stabilizing bracket 6 is fixedly secured to the water meter 8. As best shown on FIG. 4, a sufficient working area exists in the enclosure commonly used to house underground meters to tighten the thumbscrews.

The upper vertical stabilizing bracket arm 36 is insert through a slot in the horizontal portion of the upper stabilizing L-shaped securing bracket 38.

An intermediate stabilizing bracket arm 37 protrudes horizontally from the side of the stabilizing bracket 6 as shown on FIG. 3. This intermediate horizontal stabilizing bracket arm 37 is secured to the main body 4 at lower inverted J 39. Lower inverted J 39 is best shown on FIGS. 5 and 11. With the bracket in place, the upper securing nut 43 of the stabilizing bracket 6 may be usedto raise or lower the meter 8 to align the meter with the hex nut 10. It has been found that this stabilizing bracket 6 thus insures that rotational forces are not applied to the water meter 8, the connecting nuts or pipes 9 or the extension wrench 1 when the wrench is in operation.

Having fully described my device, I claim:

1. An extension wrench for tightening or loosening nuts, attachable to an underground water meter or the like, comprising:

a pair of upper handles connected to a main body, one of said handles pivotally connected to said body and also pivotally connected to a drive rod, such that pivoting said handle supplies force to said drive rod;

said drive rod having its upper end connected to said pivoting handle and its lower end connected to a ratchet gear, whereby said gear is driven by said handle and rod;

wherein said ratchet gear comprises a larger curved portion pivotally connected to a smaller curved latching piece portion at a latching piece pivot point such that said curved portions form a continuous circular gear when in closed position;

wherein said smaller latching piece portion has an inner shoulder such that said curved gear portions are kept in the closed position when said gear is placed around a nut;

whereby said smaller latching piece pivots to an open position when said gear is disengaged from a nut and said latching piece pivot point is located in a predetermined position;

further comprising a stabilizing bracket detachably connected to the body of said extension wrench by wrench-bracket attaching means, wherein said bracket comprises an upper portion connected to an upper portion of said extension wrench by an upper portion of said wrench-bracket attaching means and a lower portion, wherein said lower portion is connected to a lower portion of said extension wrench by a lower portion of said wrench-bracket attaching means and also to said water meter by a meter-bracket attaching means;

whereby said extension wrench is prevented from movement relative to said water meter when said gear is rotated.

2. An extension wrench for tightening or loosening nuts as in claim 1, wherein said meter-bracket attaching means comprises left and right lower reversed Js adapted to receive lower left and right portions of said water meter respectively, and a pair of opposed thumbscrews, adapted to be tightened about the central portion of said water meter.

3. An extension wrench for tightening or loosening nuts as in claim 2, further comprising a retractable nut retaining means located on one side of said ratchet gear, whereby nuts to be fastened may be urged towards the corresponding threads.

* * * * *